United States Patent [19]

Novorr

[11] 3,972,496

[45] Aug. 3, 1976

[54] KITE PARACHUTE CARRIER

[76] Inventor: Gerald D. Novorr, 850 Thayer Ave., Los Angeles, Calif. 90024

[22] Filed: Apr. 14, 1975

[21] Appl. No.: 567,626

[52] U.S. Cl. ..... 244/155 R
[51] Int. Cl.[2] ..... A63H 27/08
[58] Field of Search ..... 244/155 R, 153 R; D34/15 AF

[56] References Cited

UNITED STATES PATENTS

| | | | |
|---|---|---|---|
| 1,844,594 | 2/1932 | Peterson | 244/155 R |
| 3,482,807 | 12/1969 | Morris | 244/155 R |

*Primary Examiner*—Trygve M. Blix
*Assistant Examiner*—Barry L. Kelmachter
*Attorney, Agent, or Firm*—Harvey S. Hertz

[57] ABSTRACT

A kite parachute carrier formed of a base having a first and second upstanding arm secured thereto. A first pair of aligned openings are formed in each of the arms to define a kite cord guide. A second pair of aligned openings are formed in each of the arms. One of the arms contains a third opening. A slidable release is formed of a main rod having a first end and a second end. The main rod extends through the second pair of aligned openings. An intersecting member is connected to the main rod first end for preventing the main rod first end from sliding into the area intermediate the first and second arms. A releasing rod extends through the third opening and is generally parallel to the main rod. One end of the releasing rod terminates intermediate the upstanding arms and the other end is connected to the main rod second end for enabling the main rod and the releasing rod to move jointly. An aperture is formed in the base, with the releasing rod one end being movable from a first position defined by a plane intersecting the base intermediate the base aperture and the first arm to a second position defined by a plane intersecting the base intermediate the base aperture and the second arm.

3 Claims, 3 Drawing Figures

KITE PARACHUTE CARRIER

BACKGROUND OF THE INVENTION

1. Field of the Invention

The field of art to which the invention pertains includes the field of kite parachutes, particularly with respect to a kite parachute carrier for releasably carrying a parachute along a kite cord.

2. Description of the Prior Art

Conventional kite parachute carriers are formed of a relatively complex mechanism which tends to stick or travel slowly along the parachute kite cord. Typically, such carriers which if not formed with enclosed guides tend to fall off the kite cord. Alternatively, where the guides have been enclosed, the complexity of the carrier has resulted in a relatively expensive device.

Known prior art includes U.S. Pat. Nos. 2,452,746; 2,535,165; 2,598,030; 2,680,584; 2,951,666; 3,281,099; and 3,779,491.

The present invention provides an improved kite parachute carrier which can be easily and simply manufactured. The carrier once installed on a kite cord cannot fall off the cord. In addition, the mechanism for releasing the parachute is of relatively simple construction. The kite parachute carrier travels with ease along the kite cord until the release mechanism is triggered.

SUMMARY OF THE INVENTION

A kite parachute carrier contains a base having a first and second upstanding arm secured thereto. A first pair of aligned openings are formed in each of the arms to define a kite cord guide. A second pair of aligned openings are formed in each of the arms and a third opening is formed in one of the arms. A slidable release is formed of a main rod having a first end and a second end, the rod extending through the second pair of aligned openings. An intersecting member is connected to the main rod first end, preventing the main rod first end from sliding in the area intermediate the upstanding arms. A releasing rod extends through the third opening and is generally parallel to the main rod. The releasing rod has one of its end terminated intermediate the upstanding arms and the other end connected to the main rod second end for enabling a main rod and the releasing rod to move jointly. An aperture is formed in the base, the releasing rod one end being movable from a first position defined by a plane intersecting the base intermediate the base aperture and first arm to the second position defined by a plane intersecting the base intermediate the base aperture and the second arm.

The advantages of this invention, both as to its construction and the mode of operation, will be readily appreciated as the same becomes better understood by reference to the following detailed description when considered in connection with the accompanying drawings in which like reference numerals designate like parts throughout the Figures.

DESCRIPTION OF THE PREFERRED EMBODIMENTS

Figure 1:
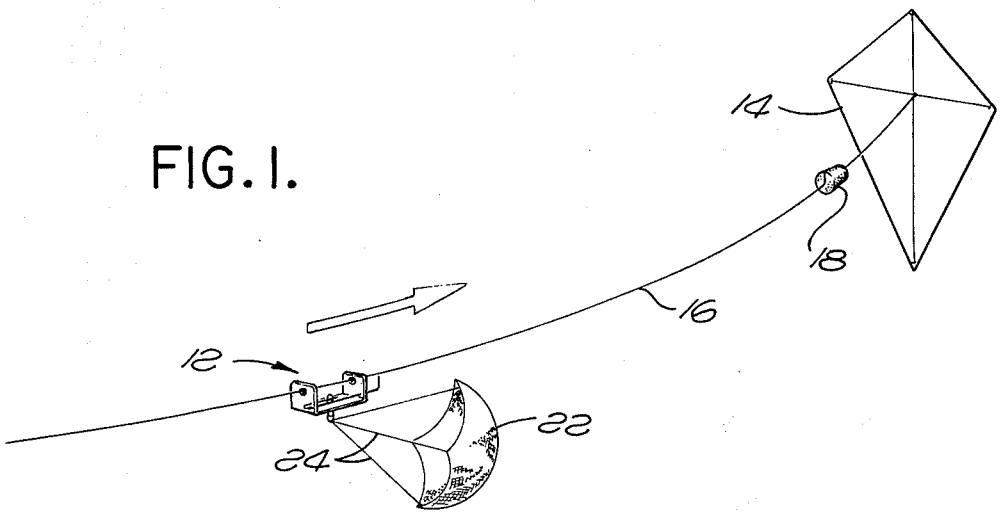
FIG. 1 is a perspective view illustrating the application of the kite parachute carrier of the present invention on a conventional kite cord.

Referring now to the drawings, it is shown in FIG. 1 a kite carrier 12 constructed in accordance with the principals of the invention and utilized in combination with a conventional kite parachute system. As is conventional in such systems, the kite 14 is normally flown and is controlled by a person on the ground by means of a kite cord 16. Positioned on the kite cord 16 adjacent the kite 14 is a parachute release actuating mechanism 18 which is normally formed of a light-weight member such as cork or polystyrene. As is typical, the parachute release actuating mechanism 18 is slit so as to facilitate its insertion on to the kite cord 16.

A parachute 22 which can be of any shape, but is illustrated in FIG. 1 as a conventional member made of paper or cloth. Corners of the paper or cloth portion of the parachute are secured by means of a string 24 to a central joint 26. The central joint in turn is secured to a clip member 28 at one end thereof. In FIG. 1, the clip member 28 is illustrated as a conventional paper clip with the joint 26 attached to one end of the clip. The other end of the clip member 28 extends into the kite parachute carrier enabling the parachute 22 to be releasably secured thereto.

As is conventional when utilizing a kite parachute carrier, the parachute release actuating mechanism 18 is secured adjacent the kite 14. The kite parachute carrier 12 is secured to the kite cord 16 in a manner which will be explained in greater detail hereinafter. The carrier is normally adjacent to the holder (not shown) of the kite cord 16 who is standing on the ground. When the kite 14 is aloft, the parachute 22 is then attached to the kite parachute carrier 12. The surface area of the parachute 22 is such that the parachute enables the carrier 12 to tend to travel toward the kite 14. A releasing mechanism (which will be explained in greater detail hereinafter) is actuated by the parachute release actuating mechanism 18 when the carrier 12 abuts the release actuating mechanism 18. The parachute 22 is then released from the carrier 12 and floats downwardly. Without the parachute surface area secured to the carrier 12, the carrier then proceeds to move rapidly along the kite cord toward the holder on the ground at which time a new kite parachute can be loaded onto the carrier and the procedure repeated.

Figure 2:
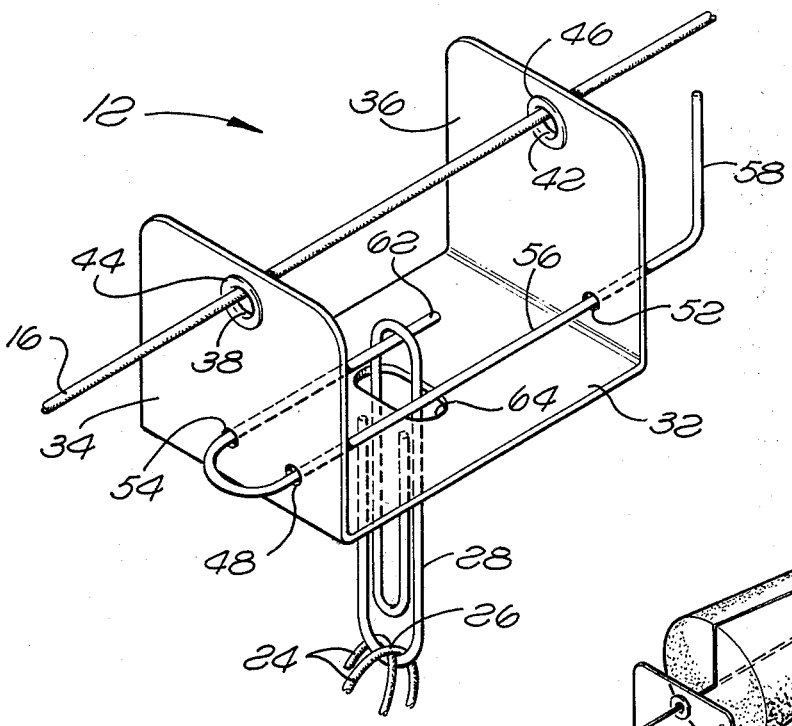
FIG. 2 is a perspective view of the kite parachute carrier in a first operational position.

Referring now to FIG. 2, there is shown in greater detail, the kite parachute carrier 12 of the present invention. The kite parachute carrier comprises a generally rectangular base 32 containing first and second upstanding arms 34 and 36 extending in a plane perpendicular to the base 32. Each of the arms 34 and 36 contain an opening 38 and 42, respectively, adjacent the free end of the arms. Eyelets 44 and 46 are secured in each of the openings 32 and 42 respectively, and form a guide for the kite cord 16 enabling the carrier 12 to travel along the kite cord 16. Typically, the eyelets 44 and 46 are made of nylon or smooth finished metal so as to prevent the kite cord 16 from breaking or being cut by the carrier.

A second pair of aligned openings 48 and 52 are formed in one of the arms 34 and 36, respectively, adjacent the base 32. In addition, a third opening 54 is formed in the arm 34 adjacent to the opening 48. A main rod 56 extends slidably through the second pair of openings 48 and 52. An intersecting member 58 is secured to one end of the main rod 56 so as to prevent the end of the rod from sliding into the area intermediate the arms 34 and 36. A releasing rod 62 extends through the opening 54 in the arm 34 with its free end terminating intermediate the arms 34 and 36. The other end of the releasing rod 62 is secured to the end of the main rod 56 which extends through the opening 48 in the arm 34. Thus, the main rod 56 and the releasing rod 62 move jointly.

A central oval aperture 64 is formed in the base 32 enabling the clip 28 to extend therethrough. The clip 28 is secured over the free end of the releasing rod 62. In normal operation, the intersecting member 58 faces the kite 14 and is separated a maximum distance from the arm 36. In this position, the clip 28 of the parachute 22 is attached to the releasing rod 62 free end and passes through the aperture 64.

Figure 3:
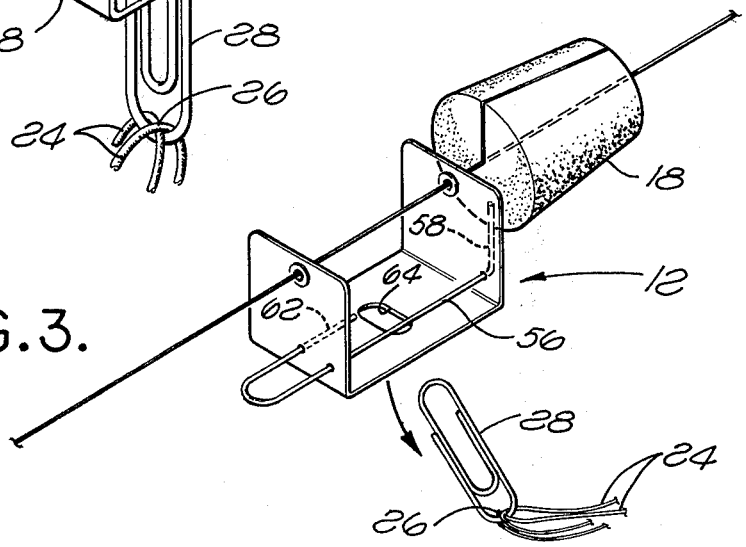
FIG. 3 is a perspective view of the kite parachute carrier in a second operational position.

The carrier 12 then moves along the kite cord 16 toward the kite 14 and the release actuating mechanism 18. When the carrier intersecting member 58 abuts the release actuating mechanism 18, the carrier continues to move toward the release actuating mechanism 18 and the intersecting member 58 is forced adjacent the arm 36 as shown in FIG. 3. The clip 28 is freed from the releasing rod 62 as the main rod 56 and the releasing rod 62 move jointly. The parachute then floats gently toward the ground and the carrier 12 returns toward ground along the kite cord 16 to once again be reloaded with a new parachute.

It should be noted that the releasing rod 62 free end extends in a plane intermediate the aperture 64 and the arms 36 when the clip 28 has been secured thereto. After the intersecting member 58 abuts the release actuating mechanism 18, the free end of the rod 62 moves to a position intermediate the aperture 64 and the arm 34.

I claim:

1. A kite parachute carrier consisting of:

a base having a first and second upstanding arms integral with and formed perpendicular to said base;

a first pair of aligned enclosed apertures formed in each of said arms defining a kite cord guide;

a second pair of aligned apertures formed in each of said arms;

a third aperture formed in only one of said arms;

a slidable release formed of a main rod having a first end and a second end and extendng through said second pair of aligned apertures, an intersecting member connected to said main rod first end for preventing said main rod first end from moving into the area intermediate the upstanding arms;

a releasing rod extending through said third aperture and generally parallel to said main rod and having one end terminated intermediate said upstanding arms and the other end connected to said main rod second end for enabling said main rod and said releasing rod to move jointly; and a fourth aperture formed in said base, said releasng rod one end being movable from a first position defined by a plane intersecting said base intermediate said base aperture and said first arm to a second position defined by a plane intersecting said base intermediate said base aperture and said second arm.

2. A kite parachute carrier in accordance with claim 1 wherein said movement of said releasing rod is limited in said first position by said intersecting member connected to said main rod first end.

3. A parachute kite carrier in accordance with claim 2 wherein said releasing rod is limited in said second position by the connection of said main rod and said releasing rod.

* * * * *